United States Patent [19]

Gasser

[11] 4,136,461

[45] Jan. 30, 1979

[54] SIGHTING DEVICE FOR BOW

[75] Inventor: Max Gasser, Berneck, Switzerland

[73] Assignee: Max Gasser AGF Produktion, Berneck, Switzerland

[21] Appl. No.: 842,876

[22] Filed: Oct. 17, 1977

[30] Foreign Application Priority Data

Jun. 29, 1977 [FR] France ..... 77 20546

[51] Int. Cl.[2] ..... F41G 1/46

[52] U.S. Cl. ..... 33/265

[58] Field of Search ..... 33/265; 124/87

[56] References Cited

U.S. PATENT DOCUMENTS

| | | | |
|---|---|---|---|
| 3,355,809 | 12/1967 | Guyton | 33/265 |
| 3,574,944 | 4/1971 | Reynolds | 33/265 |
| 3,787,984 | 1/1974 | Bear et al. | 33/265 |
| 3,854,217 | 12/1974 | Killian | 33/265 |
| 3,864,836 | 2/1975 | Haines | 33/265 |
| 4,020,560 | 5/1977 | Heck | 33/265 |

*Primary Examiner*—Richard R. Stearns

*Attorney, Agent, or Firm*—Richard L. Schwaab

[57] ABSTRACT

A sighting device is provided for a bow in which a sight is supported on a mount and the mount is mounted on a toothed rack. The mount has a worm gear thereon which meshes with the teeth of the rack to allow vertical adjustment of the mount and thus the sight with respect to the rack in order to adjust for altitude. The rack includes a standard scale thereon and a space for individualized markings of altitude gradations. Preferably, the rack is attached to a horizontal support having a slot extending therein. A bolt fits through the slot in the horizontal support and is screwed to a cradle secured to the bow in order to mount the sighting device on the bow.

10 Claims, 18 Drawing Figures

28
16
23
26
27
43
44

59
47
50
48

36
34
35
33
32

49
57

55
51
52

11
8
5
7
13
4

25
53
54
31
17
18
15
19
56
46
21
22
20
45

SIGHTING DEVICE FOR BOW

BACKGROUND OF THE INVENTION

The invention relates to a sighting mechanism for bows which is provided with a toothed rack and a graduated scale for adjusting altitude and accommodating a laterally adjustable sight.

In competitive archery, a distinction is made between two main disciplines. In FITA-archery (an internationally federated organization), one shoots at fixed targets at given standardized ranges. When hunting with bow and arrow, the target varies in respect to height and ranges are shorter. In order to compensate for target deviations that are due to false sightings, sighting devices with adjustable height and side beads are in use; as for example, the device published in U.S. Pat. No. 3,355,809, the disclosure of which is incorporated herein by reference. Sighting devices are also known which can be adjusted to given target ranges by means of depth tuning. For example, the sight can slide in a horizontal mount which is provided with a calibrated scale. The setting is noted by the archer who makes the required changes corresponding to a given distance.

The time required to make these necessary calibration changes is especially disadvantageous when hunting where it is desired for the archer to make sighting adjustments as quickly as possible.

SUMMARY OF THE INVENTION

In view of the foregoing considerations, it is an object of the instant invention to provide a sighting device for bows wherein sighting adjustments can be made as quickly as possible.

It is a further object of the instant invention to provide a sighting device for bows wherein altitude markings on the sighting device may be applied on an individualized or acustomized basis.

In view of the foregoing objects and other objects, the instant invention contemplates a sighting device for a bow which includes a sight which is supported on a mount wherein the mount has a worm gear thereon which meshes with a toothed rack that in turn supports the mount. Upon turning the worm gear, altitude adjustments of the sight can be made. The rack includes a standard scale for reading altitude and a space for individualized markings of altitude gradations. The rack is attached to a horizontal support having a slot extending therein wherein the slot has a plurality of depressions which receive a bolt having an enlarged portion. The bolt is screwed to a cradle which is in turn secured to the bow in order to attach the sighting device to the bow.

Further, in accordance with the instant invention, the mount for supporting the sight may have an offset lever thereon for mounting the worm gear wherein the offset lever is pivoted with respect to the mount and a spring means is provided for biasing the offset lever in order to hold the worm gear in engagement with the toothed rack. Preferably, the lever includes a finger grip means enabling an archer to easily disengage the worm gear from the tooth rack.

In addition, the sighting device of the instant invention may include a non-circular opening in the mount wherein a non-circular spindle is slidably received within the non-circular opening. The non-circular spindle has a threaded bore affair through to which the sight is threadably secured and which receives a threaded shank of a rotatable adjusting knob, whereby when the knob is rotated, the spindle and sight move axially with respect to the bore and laterally with respect to the bow.

Further, in accordance with the instant invention, the sight includes an interchangeable aperture which may be interchanged with apertures of different configurations.

DESCRIPTION OF THE PREFERRED EMBODIMENT

According to the invention, a sighting mechanism is provided, in addition to a scale for altitude adjustments, wherein the sighting mechanism has a plate on which can be registered altitude calibration markings that are individualized or customized. A toothed rack is provided having a recess with an edge on one side plate that is shaped like a keyway. An angle plate, which is screwed to the projection, has a second side plate which forms a longitudinal grooved wedge or keyway. This grooved wedge can be slid selectively on a spline of a vertical guide, that is connected with the bow, or it can be slid on the spline of a horizontal guide. The horizontal guide has depth adjustment calibrations which correspond to counter-sinkings in the slot guide and is provided with a rounding which rests in a shell or cradle. The cradle is connected to the bow. The cradle can be mounted by means of a screw which is fitted with a conical extension. The sight mount is provided with two guide plates. One plate has a slot which can be deformed by means of a screw. The other plate has a hexagonal section that is connected to the sight. The hexagonal section is provided with a scale and can be shifted inside a hexagonal guide groove. The sight is provided with interchangeable apertures. A compression spring exerts pressure on an offset lever which is mounted on the sight's housing. One end of the lever is provided with a worm gear and presses onto a gear-tooth system while the other end of the lever is provided with serrations with which to lift-off the worm gear. The spur or toothed rack can be made of an aluminum alloy whose surface is anodized. The individual calibrations can be glued to the surface by means of an adhesive tape or they can be screwed onto the surface in the form of interchangeable strips. The surface can be provided on a separate mount or carrier. The housing of the sight can be made of fiberglass material.

Figures 1, 3, 8, 9, 10:
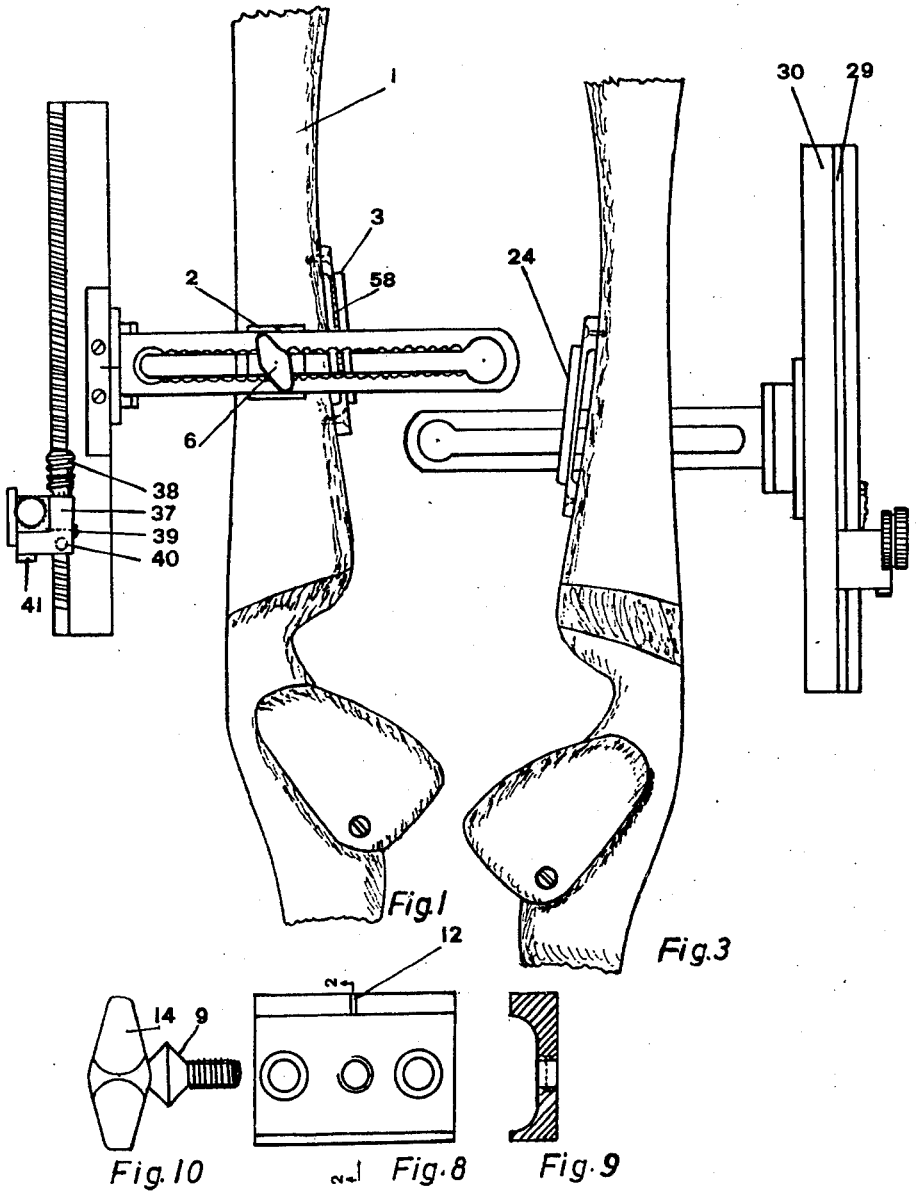
FIG. 1 is a side view of a sighting device in accordance with the instant invention.
FIG. 3 is a side view of the sighting device of FIG. 1 showing the opposite side of the device.
FIG. 8 shows a shell or cradle.
FIG. 9 is a cross-section taken along line 2—2 of FIG. 8.
FIG. 10 shows a turn screw.

Referring now to the drawings, and specifically to FIG. 1, in order to mount the sight on a bow 1, the cradle 2 and vertical support 3 are screwed onto the bow. A horizontal support or bar 5 rests in the cradle 2 at the point of a round depression 4 in the horizontal support which receives a turnscrew 6. Along the edges of a slot 7 are located depressions 8. These correspond to a conic extension 9 of the turnscrew 6 and thus allow positioning which takes cognizance of a given calibration 11, which, in turn, relates to marking 12 of the cradle 2 (see FIG. 8). An enlarged opening 13 at one end of the slot 7 allows removal of the horizontal support 5 from the turnscrew 6 by accommodating the wings 14 and conic extension 9 when the wings 14 are positioned to extend in the direction of the slot 7.

Figures 2, 4, 5, 6, 7, 11, 12, 13:
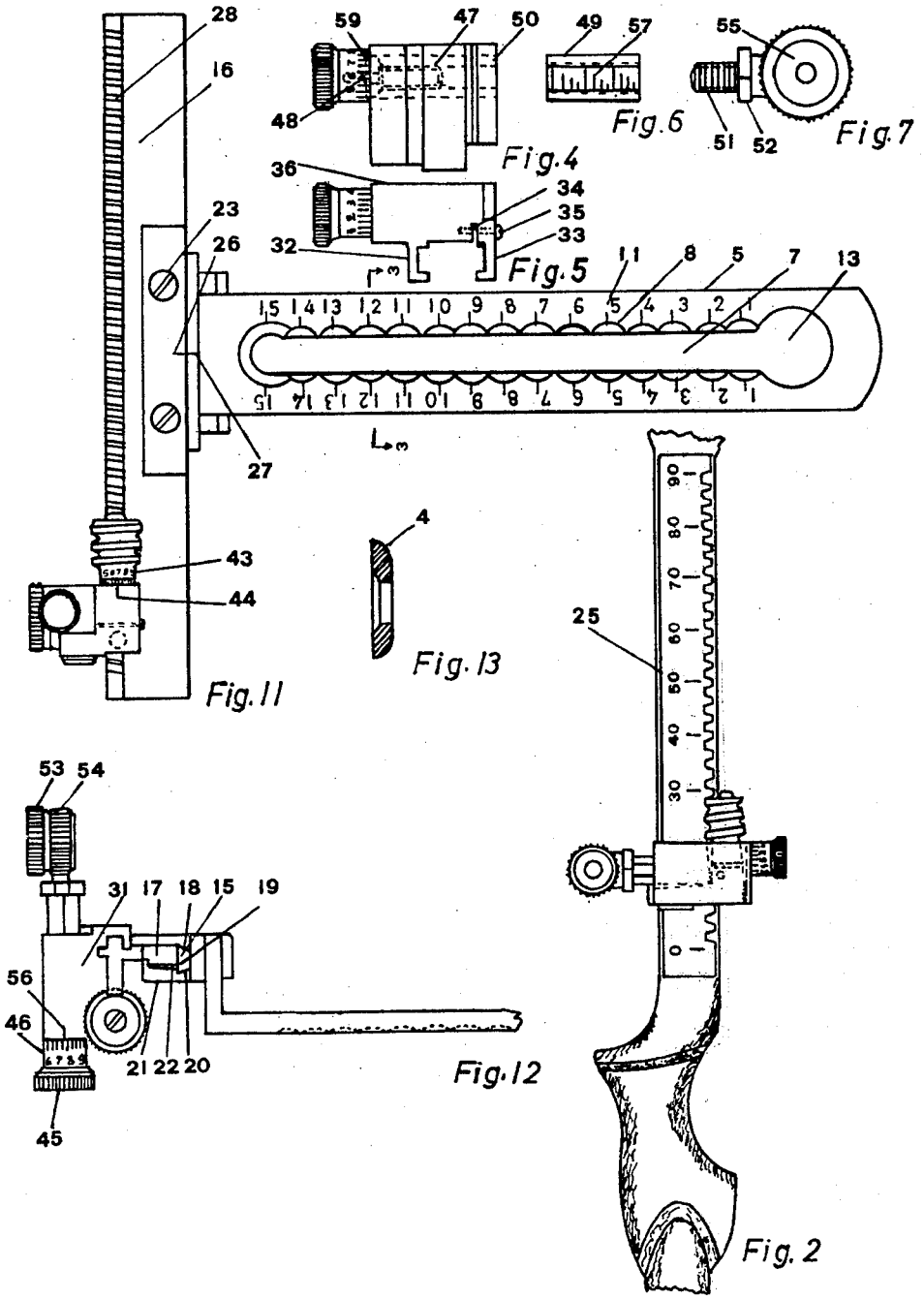
FIG. 2 is a top view of the sighting device of FIG. 1.
FIG. 4 is a side view of a housing of the sight with a rotary knob.
FIG. 5 is a top view of the housing of FIG. 4.
FIG. 6 shows the guide piece.
FIG. 7 shows a sight.
FIG. 11 is a side view of the sight mechanism alone.
FIG. 12 is a top view of the sight in FIG. 11.
FIG. 13 is a cross-section taken along line 3—3 of FIG. 11.
Figure 16:
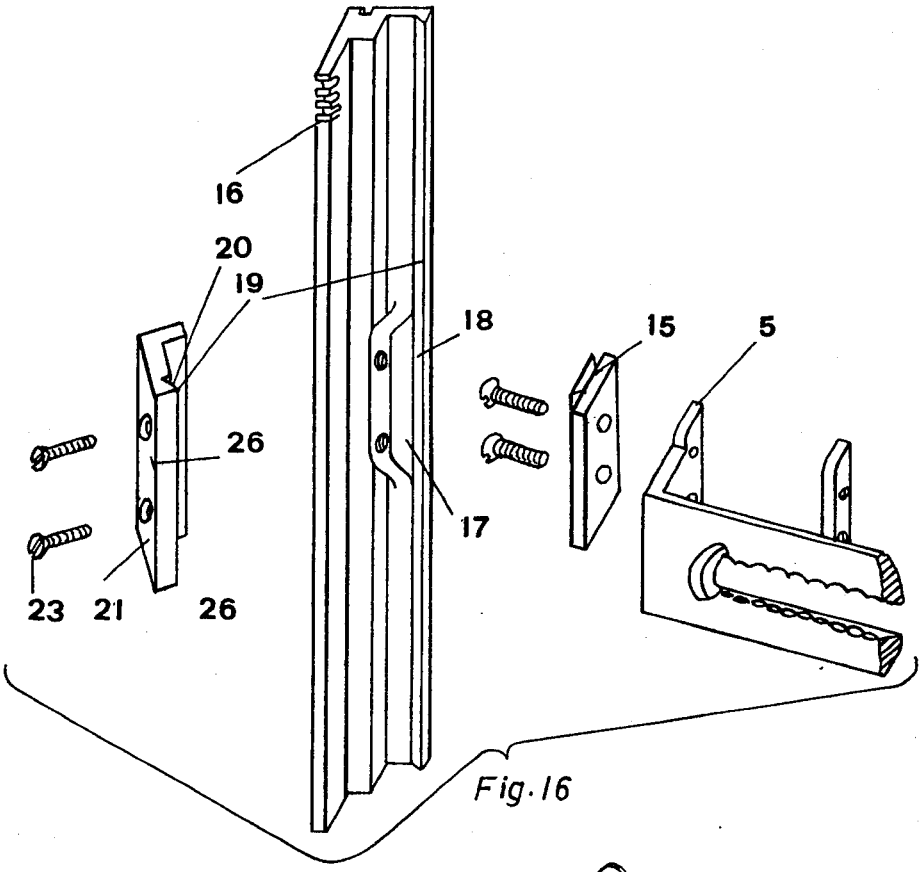
FIG. 16 is an exploded perspective view showing a dovetail mounting arrangement for the sighting device.

The horizontal support or bar 5 is provided with a dovetail key 15. A toothed rack 16 has a projection, one edge of which is shaped as a side plate 18 which cooperates with a second side plate 20 to form a keyway 19. The second side plate 20 is placed on one edge of an angle plate 21 and spaced therefrom by a gap 22 which allows the angle plate 21 to be drawn closer by means of screws 23 (FIGS. 11, 12, and 16). As a result, the toothed rack 16 is tightly clamped to the keyway 15. In the same way it is possible for the toothed rack 16 to be clamped on the groove or spline 24 of the vertical support 3.

The toothed rack 16 is provided on its front side with a scale 25 (FIG. 2). The angle plate 21 has a marking 26 which corresponds with a marking 27 on the vertical support 3 (FIG. 11). The edge of the right front of the rack 16 has teeth 28. Behind this edge, on the left front, is the groove 29 (FIG. 3) and behind this groove, is the surface 30. The surface 30 is anodized and serves to accommodate customized calibrations for altitude adjustments when the bow 1 is housed in the hunting mode. The sight mount 31 (FIGS. 11 and 12) envelopes the toothed rack 16 with its guides 32 and 33 (FIG. 5). A slot 34 in the mount 31 can be narrowed by means of a screw 35 because the housing 36 of the sight mount 31 is made of relatively elastic fiberglass. The sight housing 36 becomes deformed enough so as to allow the guides 32 and 33 to align to the toothed rack 28. Consequently, the sight mount 31 can slide along the toothed rack without any play.

Figure 14:
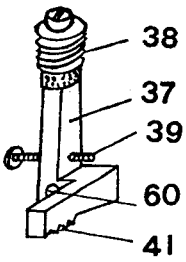
FIG. 14 is a perspective view of a pivotable lever for selectively engaging an adjusting worm gear.
Figure 15:
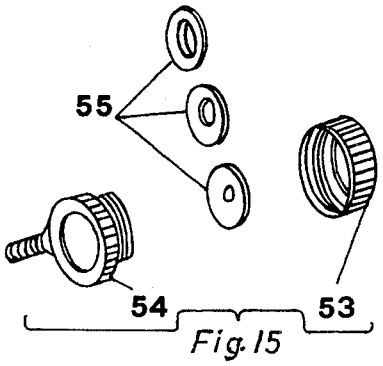
FIG. 15 is an exploded perspective view of interchangeable sighting apertures used with a sighting eyepiece.

A worm gear 38 is mounted on an offset lever 37 (see FIG. 1). The worm gear 38 can be pivoted into engagement with the teeth of the toothed rack 16. The lever 37 is attached to the sight housing 36 by means of a screw 39. A compressed spring 40, which is not visible, is seated in the hole 60 (FIG. 14) and holds the lever 37 away from the sighting housing 36 so that the worm gear 38 is pressed against the toothed rack 16. In order to disengage the worm gear 38 from the toothed rack 16 for a rapid adjustment, one pushes a serrated end 41 of the lever 37.

The worm gear is provided along its circumference with a scale 43 having gradations correspond with a marking 44 on the housing and representing the altitude positions (see FIG. 11). By turning the worm gear 38, the sight mount 31 shifts vertically along the spur rack 16 whose scalar markings 25 (FIG. 4) are also used. A rotary knob 45 has a projection fitted with the scale 46. It is connected to the interior of the sight's housing 36 by means of a threaded shaft 47 (FIG. 4). The rotary knob 45 is connected with the housing by means of the tightening disk 59 (FIG. 4) and is secured by a locking pin 48. The threaded shaft 47 reaches the inner thread of a hexagonal guide piece or non-circular spindle 49 which fits into a hexagonal guide or non-circular opening 50 of the sight's housing 36 in such a manner to allow for sliding movement relative thereto. On the opposite side of the continuous inner thread, a screw 51 (FIG. 7) is screwed therein which, in turn, is secured in its position by means of a lock nut 52. An aperture case 54 is rigidly connected with the screw 51. A screw cap 53 holds an exchangeable aperture 55 inside the aperture housing 54.

By turning the rotary knob 45, the spindle 47 shifts the hexagonal guide 49 and also the aperture housing 54. The corresponding side adjustment can be read off the scale 46 (FIG. 12) by way of a marking 56 and also from the hexagonal guide plate 49 by a number of visible gradations 57.

Figure 17:
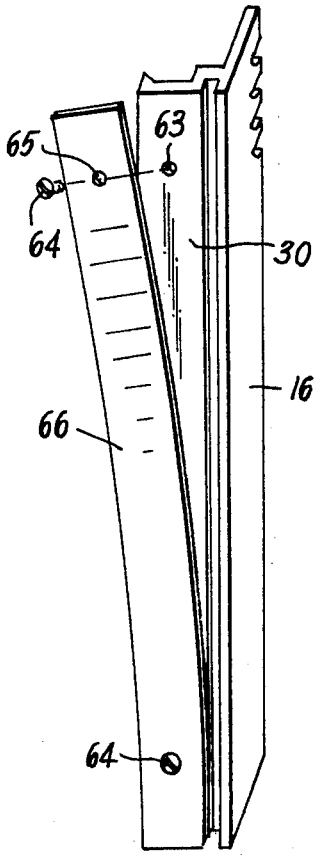
FIG. 17 is a perspective view showing a rack with altitude marking strips being mounted thereon with screws.

As is seen in FIG. 17, the rack 16 may be provided with threaded holes 63 in surface 30 to receive screws 64 which pass through holes 65 in customized marking strips 66 to retain the strip 66 on surface 30 of the rack.

Figure 18:
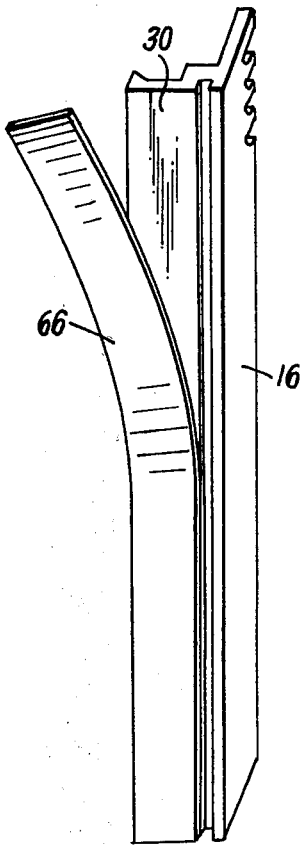
FIG. 18 is a perspective view showing a rack with altitude marking strips being glued thereon.

As seen in FIG. 18, the customized marking strips 66 may be glued or otherwise adhesively secured to the surface 30.

Given these options, the archer will be able to adjust the sighting mechanism of the bow quickly to the standardized target distances used in FITA competition. When hunting and shooting at targets with different altitudes and at relatively short distances, the archer can inscribe on the surface 30 (FIG.3) with erasable markings which relate to given target arrays and allow for possible corrections or optionally the archer can glue or attach customized marking strips 66 to the surface 30. When operating in free terrain it will be advantageous to avoid using horizontal support 5 (FIG. 1). The available targets can be sighted by sliding the toothed rack 16 onto the spline 24 of the vertical support 3 (FIG. 3). Altitude adjustments are then made via the markings 26 (FIG. 11) on the scale 58 (FIG. 1).

I claim:

1. A sighting device for attachment to a bow, comprising:

a sight for aiming arrows;

a mount for supporting the sight;

a worm gear rotatably attached to the mount;

a rack having teeth and means for slidably retaining the mount thereon with the worm gear meshed with the teeth whereby rotation of the worm gear advances the mount along the rack;

a bar having a slot extending therein wherein the slot has a periphery with a plurality of similarly formed spaced depressions;

means for mounting the rack on the bar so as to extend generally normal to the bar;

a threaded bolt passing through the slot in the bar and having an enlarged portion complementing individually the depressions of the slot; and a cradle for attachment to a bow, said cradle having a threaded opening therein in which the bolt is screwed to hold the bar in selected positions with respect to the cradle; whereby when the cradle is attached to a bow, the rack retaining the mount for the sight may be spaced selected distances from the bow by adjusting the position of the bolt with respect to the slot in the bar and the sight may be advanced along the rack to adjust the altitude thereof with respect to the bow.

2. The sighting device of claim 1 further comprising:
a standard scale on the rack for reading altitude; and
a space on the rack for individualized markings of altitude gradations.

3. The sighting device of claim 2 wherein the toothed rack is made of an aluminum alloy and wherein the space for individualized markings is anodized.

4. The sighting device of claim 2 wherein a strip is glued to the space for individualized markings and wherein the markings are made on the strip.

5. The sighting device of claim 2 wherein interchangeable strips for individual customized markings are mounted on the space for individualized markings by screws.

6. The sighting device of claim 2 wherein a separately provided strip is mounted in the space for individualized markings so that the individualized markings can be made on the strip.

7. The sighting device of claim 1 wherein the mount for supporting the sight further comprises:
an offset lever having the worm gear attached thereto and pivoted with respect to the mount, and
spring means biasing the offset lever to hold the worm gear in engagement with the toothed rack.

8. The sighting device of claim 7 wherein finger grip means are provided on the offset lever for enabling an archer to pivot said lever and thereby disengage the worm gear from the toothed rack.

9. The sighting device of claim 8 wherein the mount includes an opening having a non-circular cross-section therein which slidably and non-rotatably receives a spindle with a threaded bore therethrough to one end of which the sight is threadably secured, and wherein the mount includes a knob rotatably mounted thereon with a threaded shank received within the other end of the threaded bore whereby when the knob is rotated, the spindle and sight move axially with respect to the opening.

10. The sighting device of claim 9 wherein the sight has an interchangeable aperture removably mounted thereon which is interchangeable with other apertures not mounted thereon.

* * * * *